United States Patent [19]

Rastogi

[11] 4,309,949

[45] Jan. 12, 1982

[54] METHOD OF CONTROLLING THE OPACITY OF THE EXHAUST OF THE COMBUSTION OF SOLID FUEL AND AIR IN A FURNACE

[75] Inventor: Laxmi K. Rastogi, San Jose, Calif.

[73] Assignee: Measurex Corporation, Cupertino, Calif.

[21] Appl. No.: 101,810

[22] Filed: Dec. 10, 1979

[51] Int. Cl.[3] ..... F23B 7/00

[52] U.S. Cl. ..... 110/341; 110/188; 236/15 E; 431/2; 431/76

[58] Field of Search ..... 110/185, 188, 341; 236/15 E; 431/76, 2

[56] References Cited

U.S. PATENT DOCUMENTS

| | | | |
|---|---|---|---|
| 3,184,686 | 5/1965 | Stanton | 236/15 E |
| 3,701,622 | 10/1972 | Duzasse | 236/15 E X |
| 4,032,285 | 6/1977 | Rohr et al. | 431/76 X |
| 4,043,743 | 8/1977 | Seider | 236/15 E X |

*Primary Examiner*—Edward G. Favors

*Attorney, Agent, or Firm*—Ronald Yin; Hal J. Bohner

[57] ABSTRACT

A method of controlling the opacity of the exhaust of the combustion of solid fuel and air in a furnace comprises measuring the opacity of the exhaust. The amount of air and the direction (i.e., increase or decrease) entering into the furnace is changed. The opacity of the exhaust is measured again. The later measured value of opacity is compared to the earlier measured value. The amount of air entering into the furnace is controlled based upon the comparison.

12 Claims, 1 Drawing Figure

METHOD OF CONTROLLING THE OPACITY OF THE EXHAUST OF THE COMBUSTION OF SOLID FUEL AND AIR IN A FURNACE

BACKGROUND OF THE INVENTION

The present invention relates to a method for the control of the opacity of the exhaust of the combustion of solid fuel and air in a furnace, and more particularly, to a method of reducing the opacity of the exhaust of said combustion.

As environmental concerns have increased with regard to the discharge of waste products of combustion from a furnace, increasing attention has been focused on the level of opacity of the exhaust produced by these furnaces. At the same time, however, the recent price increases initiated by the Oil Producing Exporting Countries (OPEC) has led to an increasing awareness of the diminishing world supply of *liquid* fossil fuels. On the other hand, the world reserve of *solid* fuel, such as coal, bark, etc., is at present estimated to be much larger than the world reserve of liquid fossil fuel. The use of these solid fuels, in light of the environmental restraints, impose certain conditions in the control of the opacity of the exhaust of the combustion of the solid fuel and the air in the furnace.

Heretofore, the control of the opacity of the exhaust of combustion of solid fuel and air in a furnace has been simple and straightforward, based upon intuition. The control strategy is simply to increase the air, in the event the measured opacity level is greater than that desired and conversely to decrease the amount of air in the event the measured level of opacity is lower than that desired. It has been found, however, that while this simple and intuition-based method works well for the combustion of liquid or gaseous fossil fuel and air in a furnace, the control of the opacity of the exhaust of the combustion of solid fuel and air in a furnace necessitates a different method.

DETAILED DESCRIPTION OF THE INVENTION

Figure 1:
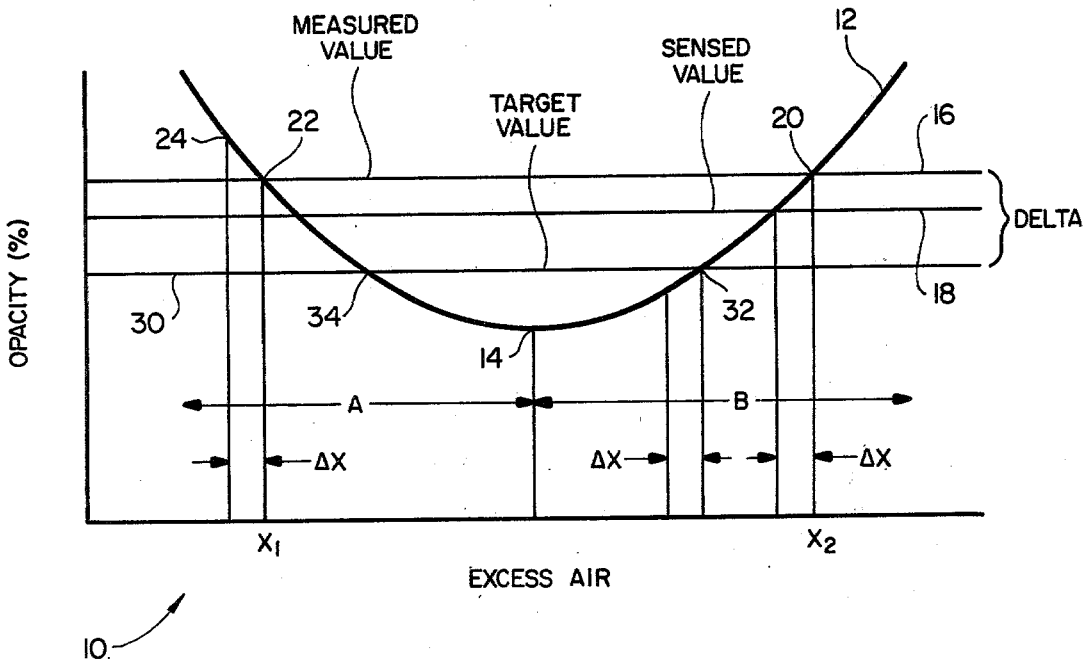
FIG. 1 is a graph of the amount of opacity as a function of the amount of excess air.

Referring to FIG. 1, there is shown a graph 10 of the measure of opacity as a function of the amount of excess air as a result of the combustion of solid fuel and air in a furnace. Typical solid fuel is coal and bark. Opacity is typically expressed in percentage; the standard for calculating opacity is well known and is established by environmental regulatory agencies, such as the EPA. Excess air, the horizontal axis, is also expressed in percentage. Excess air is the amount of air which is more than that required for stoichiometric combustion. Thus a five percent excess air means that air is present in an amount equal to 105% times that which is needed for stoichiometric combustion of the fuel. The graph 10 in FIG. 1 denotes a U-shaped curve 12. As can be seen from FIG. 1, the portion of curve 12 denoted as "A" shows the opacity decreasing in value as excess air is increased. The opacity decreases until a minimum value 14 is reached. Beyond point 14, in the region designated as "B", i.e., as excess air is increased further, curve 12 shows an increase in the value of opacity. The discovery of the present invention lies in the fact that the opacity does not continue to monotonically decrease as excess air is increased. On the contrary, at some point, increase of excess air would cause a sudden and inexplicable increase in the opacity. Applicant's belief as to the cause of this inexplicable increase will be discussed later.

In a method of controlling the opacity of the exhaust of the combustion of solid fuel and air in a furnace wherein the furnace has means to adjust the amount of air entering into the furnace, the opacity of the exhaust is first measured. As can be seen from FIG. 1, however, the measured value 16 of opacity may correspond to two different values of excess air, i.e., the excess air may have value of either $X_1$ or $X_2$. In order to effectively control the opacity of the exhaust of the combustion the amount of air entering into the furnace is changed. This may be done either by increasing or decreasing a small, incremental amount of air. The direction of the change, i.e., either increase or decrease, is noted. The opacity of the exhaust is then sensed (or measured again). For example, as shown in FIG. 1, let us assume that the measured value 16 corresponds to $X_2$ or point 20 on curve 12. The amount of excess air is lowered (or decreased) by an amount $\Delta X$ with the sensed value (later measured value) of opacity having a value shown as 18. The sensed value 18 of opacity is compared to the measured value 16. The comparison between the sense value 18 and the measured value 16 is used to control the opacity of the exhaust. For example, as shown in FIG. 1, where the sensed value 18 is less than the measured value 16, and it is desired to decrease the level of opacity, the amount of air is changed in the same direction as the original direction of the small incremental amount of air, i.e., $\Delta X$. In this case, the air is continued to be decreased. On the other hand, if it is desired to increase the level of opacity, and the sensed value 18 is less than the measured value 16, then the amount of air is changed in a direction opposite the initial direction of the small incremental amount of air $\Delta X$. In this case, if it is desired to increase the level of opacity and the sensed value 18 is less than the measured value 16, then the amount of excess air is increased.

As can be seen from FIG. 1, in the event the measured value 16 corresponds to point 22 on curve 12, i.e., an excess air value of $X_1$, a decrease in the amount of excess air by an incremental amount $\Delta X$ would result in a sensed value of opacity corresponding to point 24 on curve 12. The sensed value of opacity corresponding to point 24 on curve 12 would be greater than the measured value 16. Thus, where the sensed value is greater than the measured value and it is desired to decrease the level of opacity, the amount of air must be changed in the direction opposite to the original direction of the small incremental amount of air, i.e., excess air must be increased.

In another embodiment of the method of the present invention, the opacity of the exhaust of the combustion of solid fuel and air in a furnace is controlled with a target value of opacity which is a desired value of opacity. In FIG. 1 a target value 30 is shown as the desired level of opacity of the exhaust of the combustion of solid fuel and air in a furnace. The measured value 16 is greater than the target value 30 by a delta amount. The method comprises initially changing the amount of air into the furnace, as for example, by decreasing the air by an amount equal to $\Delta X$. The opacity of the exhaust is sensed (measured again). The sensed value is compared to the target value. Finally, the amount of air entering into the furnace is controlled based upon the comparison between the sensed value and the target value to the delta amount. For example, if it is assumed in FIG. 1 that the measured value 16 of the opacity level corresponds to the excess air at $X_2$, changing the excess air by an amount $\Delta X$ entering into the furnace would result in a sensed value 18. The difference between the sensed value 18 and the target value 30 is less than the delta amount. In this case, the amount of excess air is controlled in a direction of the initial change of the excess air, i.e., the excess air level is decreased. If the measured value 16 corresponded to point 22 on curve 12, i.e., an excess air value of $X_1$, decreasing the excess air by an amount equal to $\Delta X$ would result in point 24 or curve 12. The opacity level that corresponds to point 24 on curve 12 would be greater than the measured value 16. The comparison between the sensed value of opacity that corresponds to point 24 and the target value 30 would be greater than the delta amount. In this case, the amount of air entering into the furnace is changed in a direction opposite to the initial changing of the amount of air, i.e., the excess air level is increased.

In yet another embodiment of the method of the present invention, the opacity of the exhaust of the combustion of solid fuel and air in a furnace is controlled with a target value of opacity and the excess air is minimized. As can be seen from FIG. 1, a target value 30 of opacity may have two values of excess air (32 and 34 respectively) associated therewith. Excess air 32 being greater than excess air 34. For maximum efficiency of combustion, minimization of heat loss through excess air is desired. Since the target value 30 of opacity may have two values of excess air associated therewith, once the target value 30 is reached and environmental constraints are satisfied, it may be desirable for efficiency purpose to lower, if possible, excess air until the lower value of excess air that corresponds to target value 30 is reached. In this manner combustion of solid fuel and air would occur in a most efficient and environmentally acceptable condition. Specifically, the method comprises first reducing the measured value 16 of opacity until the target value 30 is reached, as discussed heretofore. Next, the amount of air entering into the furnace is reduced by a small amount. The opacity of the exhaust is noted. In the event the opacity of the exhaust is less than the target value 30, the amount of air entering into the furnace is further reduced until the opacity is at the target value 30 again. (This corresponds to the case where the target value 30 is operating at excess air 32. Further reduction of excess air would bring the opacity back to target value 30 but at a lower value of excess air, namely 34.) In the event the opacity of the exhaust is greater than the target value 30, after the excess air is reduced by a small amount, (as in the case of the target value 30 already operating at the lower value of excess air, i.e., 34), the excess air is brought back to the original level.

Applicant's belief in the theoretical basis for the U-shaped curve of FIG. 1 that is the result of the combustion of solid fuel and air in a furnace is as follows: In the portion of the curve 12 designated as "A", where increase in air results in a decrease in opacity, Applicant believes that increase in air decreases the unburnt carbon particles. However, as air level increases further, the curve 12 enters into the portion shown as "B" with a corresponding increase in opacity caused by the resultant of the combustion of the carbon particles. In particular, the combustion of solid fuel results in greater amounts of ash particles entrained in air in the flue gas than the combustion of either liquid or gaseous fossil fuels. Thus, the increase in the opacity level with a corresponding increase in excess air is due to the ash particles that are the result of the combustion of solid fuel and air. Of course, Applicant believes that further increase of air at some point would cause the opacity level to either level off or decrease yet again.

What is claimed is:

1. A method of reducing the opacity of the exhaust of the combustion of solid fuel and air in a furnace from a measured value said furnace having means to adjust the known amount of air introduced into said furnace, said method comprising:

(a) measuring the opacity of the exhaust;
(b) initially changing in a direction the amount of air introduced into said furnace;
(c) sensing the opacity of the exhaust;
(d) comparing the sensed value to said measured value; and
(e) controlling the amount of introduced air based upon the comparison between the sensed value and the measured value.

2. The method of claim 1 wherein if said sensed value is greater than said measured value, said controlling step is to alter the amount of air into said furnace in a direction opposite the direction of the initial changing of the amount of air.

3. The method of claim 1 wherein if said sensed value is less than said measured value, said controlling step is to continue to change the amount of air in the direction of the initial change.

4. A method of controlling the opacity of the exhaust of combustion of solid fuel and air in a furnace, wherein said method comprises:

(a) measuring the opacity of the exhaust;
(b) initially changing in a direction the amount of air;
(c) sensing the opacity of the exhaust;
(d) comparing said sensed value to said measured value; and
(e) reducing the amount of air if the initial change was a decrease and the sensed value is less than the measured value.

5. The method of claim 4 wherein if said sensed value is less than the measured value, said controlling step is to continue to change the amount of air in the direction of the initial change to reduce the opacity of the exhaust.

6. The method of claim 4 wherein if said sensed value is greater than the measured value, said controlling step is to alter the amount of air into said furnace in a direction opposite the direction of the initial changing of the amount of air to reduce the opacity of the exhaust.

7. A method of controlling the opacity of the exhaust of the combustion of solid fuel and air in a furnace, wherein a target value of the opacity is known, and said furnace has means to adjust the amount of air entering into said furnace, said method comprising:

(a) measuring the opacity of the exhaust and determining the difference, delta, between the measured value and the target value;
(b) initially changing in a direction the amount of air into said furnace;
(c) sensing the opacity of the exhaust;
(d) comparing the sensed value to said target value; and
(e) controlling the amount of air based upon the comparison between the sensed value and the target value to said delta amount, until the opacity of the exhaust is at said target value.

8. The method of claim 7 wherein said comparison is greater than said delta amount, and said controlling step is to alter the amount of air into said furnace in a direction opposite the direction of the initial changing of the amount of air.

9. The method of claim 7 wherein said comparison is less than said delta amount, and said controlling step is to continue to change the amount of air in the direction of the initial change.

10. The method of claim 7 further comprising:

reducing the amount of air into said furnace;

noting the opacity of the exhaust after said reduction; and adjusting the amount of air into said furnace such that the exhaust is at said target value and the amount of air into the furnace is at a minimum based upon the opacity noted.

11. The method of claim 10 wherein said opacity noted is less than said target value and said adjusting step is to continually reduce the amount of air entering into the furnace until the opacity of the exhaust is at said target value.

12. The method of claim 10 wherein said opacity noted is greater than said target value and said adjusting step is to increase the amount of air entering into the furnace until the opacity of the exhaust is at said target value.

* * * * *